United States Patent [19]

Meissner

[11] Patent Number: 4,653,740

[45] Date of Patent: Mar. 31, 1987

[54] QUICK CLAMPING APPARATUS FOR SKIS OF VARIOUS WIDTHS

[76] Inventor: Horst Meissner, Flachter Str. 10, 7000 Stuttgart 31, Fed. Rep. of Germany

[21] Appl. No.: 671,708

[22] Filed: Nov. 15, 1984

[30] Foreign Application Priority Data

Nov. 19, 1983 [DE] Fed. Rep. of Germany ... 8333285[U]

[51] Int. Cl.[4] ..... B25B 1/10

[52] U.S. Cl. ..... 269/252; 269/236; 269/906

[58] Field of Search ..... 269/252, 253, 224, 236, 269/906

[56] References Cited

U.S. PATENT DOCUMENTS 922,338 5/1909 Root ..... 269/236
1,298,919 4/1919 Erickson ..... 269/252
1,772,885 8/1930 Case ..... 269/155
4,241,906 12/1980 Cole ..... 269/153

*Primary Examiner*—Frederick R. Schmidt
*Assistant Examiner*—Judy J. Hartman
*Attorney, Agent, or Firm*—Jones, Tullar & Cooper

[57] ABSTRACT

An apparatus for the quick clamping of skis of various widths is described, having two parallel guide rods on which a movable clamping jaw is guided. By means of a threaded element and an eccentric lever, the movable clamping jaw is reciprocated in the axial direction and relative to a stationary clamping jaw. In order to attain a substantially constant clamping force with such an apparatus while providing for easy manipulation, a threaded spindle, as the threaded element, is rotatably supported and is joined in a rotationally stiff manner with the eccentric lever via a member which is elastic in the axial direction.

9 Claims, 3 Drawing Figures

QUICK CLAMPING APPARATUS FOR SKIS OF VARIOUS WIDTHS

BACKGROUND OF THE INVENTION

The present invention relates to a quick clamping apparatus for skis of various widths, preferably having two parallel guide rods on which a movable clamping jaw is guided. The movable clamping jaw is movable back and forth in the axial direction relative to a stationary clamping jaw by means of a threaded element and an eccentric lever.

In a known apparatus for quick clamping of skis of various widths of this type, the threaded element is held unrotatably by a fork passing through the stationary clamping jaw; the eccentric lever for the axial motion is articulated on the fork in a pivotable manner. An adjusting nut is disposed on the free end of the threaded element, by which means the movable clamping jaw can be adjusted to the width of a particular ski or skis.

Manipulating this known apparatus is relatively tedious and complicated when downhill skis and the narrower cross-country skis must be fastened in it at various times. A further disadvantage is that depending on this preliminary adjustment, the clamping force varies in accordance with how the preliminary adjustment is performed.

Also in the known apparatus for the quick clamping of skis, a center bit is held on the guide rods between the movable and the stationary clamping jaws, being supported on the jaws at both ends via compression springs. This enables the clamping of two skis of a pair at the same time, and the center bit is capable of automatically adjusting to a centered position between the two jaws, because of the compression springs. In this known apparatus, the clamping jaws and the center bit are each provided with a step disposed directly above the guide rods and forming a surface for the skis to rest on and against. Accordingly, the skis can be clamped only in a horizontal condition, unless additional clamping jaws are used, which is relatively inconvenient.

SUMMARY OF THE INVENTION

It is accordingly an object of the present invention to provide an apparatus of the above type for the quick clamping of skis, which is easier to manipulate and with which a clamping force which is substantially constant at all times can be attained. In such an apparatus, this object is attained by providing a rotatably supported threaded spindle as the threaded element, which is joined in a rotationally stiff manner to the eccentric lever via a member which is elastic in the axial direction.

With the apparatus according to the invention, easy manipulation is attained in that the threaded spindle can be rotated not with a special adjusting knob but rather with the eccentric lever already serving to effect the clamping per se, and the movable clamping jaw can thereby be adjusted. Since the threaded spindle is not joined directly to the eccentric lever but rather in a rotationally stiff manner via a member which is elastic in the axial direction, a substantially constant clamping force is attained, regardless of whether the movable clamping jaw is clamped firmly against the ski that is being fastened, or merely rests lightly against it. Substantially less wear occurs as a result. Furthermore, this kind of clamping also simplifies and speeds up the clamping operation, since the preliminary adjustment, or movement of the movable clamping jaw toward the ski that is to be fastened, no longer needs to be performed relatively accurately, as before.

In a preferred embodiment of the present invention, the elastic member is embodied preferably by a prestressed tension spring.

To simplify assembly, the tension spring is in effect screwed onto a spring receiving element, so that a tractile connection in the axial direction is readily attained, while at the same time it is assured that the rotatable driving connection is present via frictional engagement. In a suitable manner, the threaded spindle and the spring receiving element both have the same threading direction, thereby preventing self-loosening of the compression spring from the spring receiving elements, even if the movable threaded jaw is tightened excessively against the ski that is being clamped.

Since the eccentric lever is provided for both the rotating drive and the axial movement of the threaded spindle, it is suitably disposed resting on the outside of the stationary clamping jaw, via a thrust bearing.

In a further exemplary embodiment of the invention, the eccentric lever is lockable in a position of rest, such that the lever arm points obliquely outward; thus the movable clamping jaw is readily adjustable by rotating the threaded spindle, even if the supporting base is relatively wide. The clamping action itself, by means of the eccentric lever, can be effected in any arbitrary circumferential position.

It is a further object of the present invention to embody an apparatus for the quick clamping of skis such that the skis can be readily clamped not only lying flat, but edgewise as well. In such an apparatus, this object is attained by providing each clamping jaw with a bearing bolt, oppposite which the center bit has respective recesses.

In order to serve as bearing bolts when the skis are to be clamped horizontally, the bearing bolts must have, for a downhill ski, a certain length which is preferably more than half the width of the ski. To enable clamping of cross-country skis in a horizontal position as well, the center bit is provided with the recess, in which the protruding portion of the bearing bolt can rest when the cross-country ski is fastened in position. The same situation applies if only a single ski is clamped instead of two skis being clamped parallel to one another; then the bearing bolt of one jaw is supported on the center bit in the recess. At the same time, however, the bearing bolt is also provided with a bearing surface which cooperates with the opposing bearing surface, divided by the recess, of the center bit, so that both downhill and cross-country skis can also be clamped in place edgewise.

Accordingly, not only downhill but also cross-country skis can be clamped, singly or in pairs, either lying flat or on edge, and this great number of variant clamping modes can each be performed quickly and uncomplicatedly. This great number of possible clamping modes, which is dictated by the structure of the apparatus, is attainable both in combination with the disposition of an elastic member between the threaded spindle and the eccentric lever, and independently.

Further details and embodiments of the invention will become apparent from the ensuing description of exemplary embodiments, taken in conjunction with the drawings.

DESCRIPTION OF THE PREFERRED EMBODIMENTS

Figures 1, 2, 3:
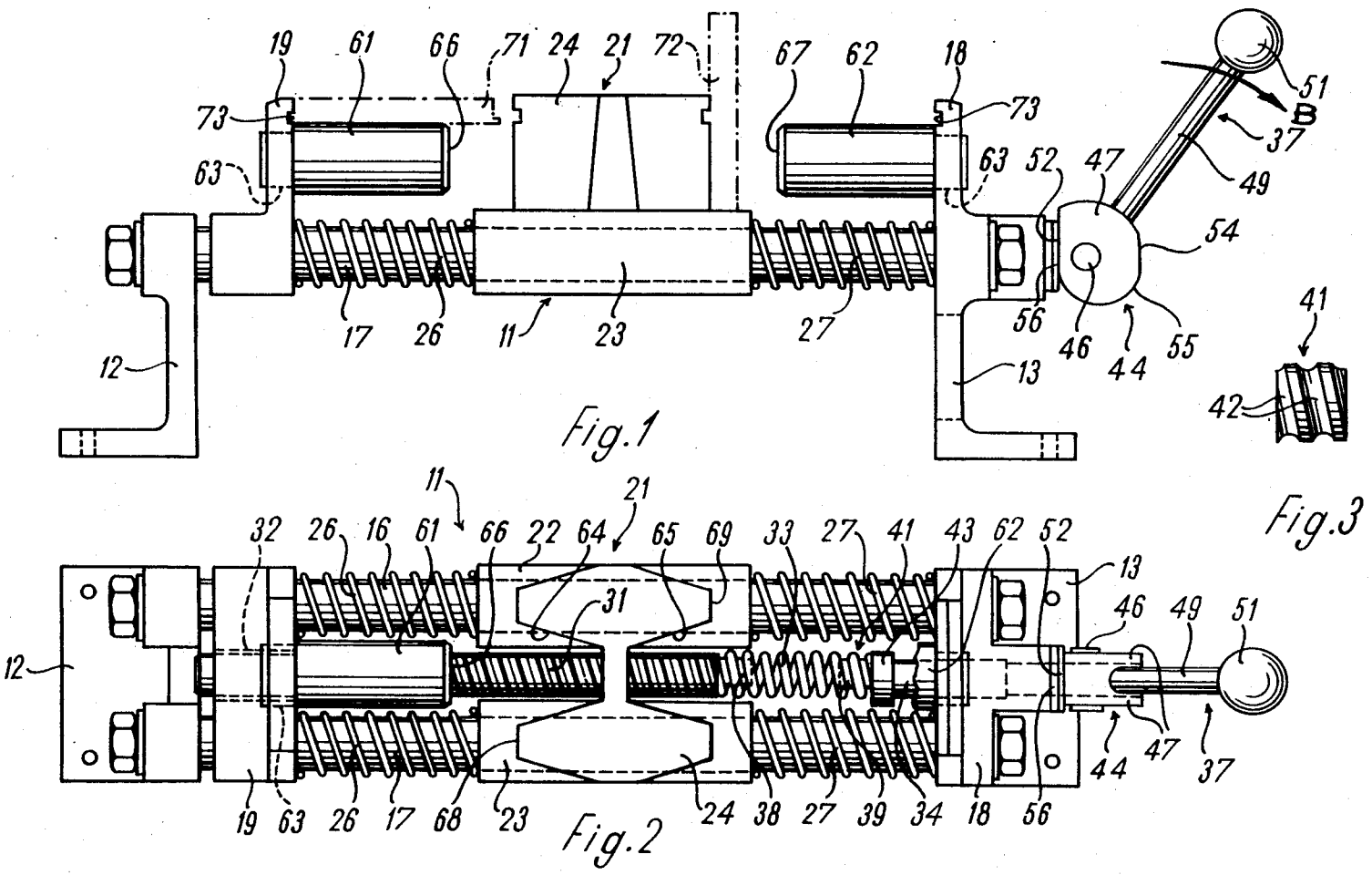
FIG. 1 is a side view of a quick clamping apparatus for skis according to a preferred exemplary embodiment of the present invention, having an eccentric lever in the position of rest.
FIG. 2 is a plan view of the quick clamping apparatus for the skis FIG. 1, showing the bearing bolt at the stationary clamping jaw in cutaway form.
FIG. 3 is a side view, on an enlarged scale, of a spring receiving element.

The apparatus 11 shown in the drawing serves to clamp skis quickly, singly or in pairs, and is usable for both downhill and cross-country skis. Clamping can be effected in either a horizontal or a vertical direction of the skis.

As shown in the drawing, the quick clamping apparatus 11 has a supporting angle piece 12, 13 at both ends, held spaced apart from one another by two firmly screwed, parallel guide rods 16, 17. The quick clamping apparatus 11 can be secured to a work bench or the like with the aid of the supporting angle pieces 12, 13. One angle piece 13 is integral with a stationary clamping jaw 18. Opposite this clamping jaw and facing the other support 12, a movable clamping jaw 19 is guided in a slidable manner on the two guide rods 16, 17. A center bit 21 is also slidably guided on the two guide rods 16, 17 by means of two blocks 22, 23 disposed parallel to one another and held together above the guide rods 16, 17 by a central double jaw 24 of the center bit 21. The two blocks 22, 23 are supported by identical, respective compression springs 26, 27 on the opposing clamping jaws 18, 19, and the compression springs 26, 27 concentrically surround the round guide rods 16, 17. In this manner, when the position of the movable clamping jaw 19 varies relative to the stationary clamping jaw 18, the center bit 21 is always held approximately centrally between these two jaws.

A threaded spindle 31 is disposed between the two guide rods 16, 17 and approximately in the same horizontal plane, one end being screwed into an internal thread 32 of the movable clamping jaw 19. The other end of the threaded spindle 31 is joined via a tension spring 33 to a tie bolt 34, which passes slidably through the stationary clamping jaw 18 and is connected at its outer end with an eccentric lever 37. The two ends 38, 39, facing one another and having smaller diameters and being smooth on the outer circumference, of the threaded spindle 31 and of the tie bolt 34, respectively, are firmly joined to a pressed-on spring receiving element 41. As shown in FIG. 3, the spring receiving element 41 has a groove 42 machined into its outer circumference in the manner of a screw thread, approximately two thread courses being provided. The pitch and the geometric cross-sectional shape of the groove 42 correspond to the pitch and shape of the tension spring 33. In other words, the tension spring 33 is screwed onto the spring receiving element 41 at both ends with radial biasing. The pitch direction of both the threaded spindle 31 and the tension spring 33 or spring receiving element 41 is the same. In this manner, by means of frictional engagement, a rotationally stiff connection is attained between each spring receiving element 41 and the associated end of the tension spring 33, and an axial tractile connection between them is attained by the interlocking shapes. The tie bolt 34 also has a collar 43, which in the axial position of rest of the threaded spindle 31 is spaced part from the inside of the bearing or stationary clamping jaw 18 and defines the maximum desirable axial movement of the threaded spindle 31.

The tie bolt 34 is pivotably joined to the fork element 44 of the eccentric lever 37 via a transversely extending shaft 46. This fork element 44 has two contoured cam discs 47 extending parallel to one another and eccentric relative to the pivot shaft 46 and is joined to a lever arm 49, on the free end of which a spherical knob 51 is secured. The contoured cam discs 47 have two linear, that is, flattened, sections 52 and 54, between which there is a contoured section 55. The fork 44 having the contoured cam discs 47 of the eccentric lever 37 is tightened by the tension spring 33, which is also biased in the position of rest, against an axial thrust bearing 56, which is embodied as a needle bearing. In FIG. 1, the eccentric lever 37 is in the position of rest, in which the linear section 52 rests on the axial thrust bearing 56 and the lever arm 49 points obliquely outward at an angle of approximately 45°. The position in which the linear section 54, which is located diametrically opposite the linear section 52, rests on the axial thrust bearing 56 represents the clamped position for one or two clamped skis.

The two clamping jaws 18, 19 each have one bearing bolt 61, 62 disposed parallel to the guide rods 16, 17 and disposed in approximately the same vertical central plane as the threaded spindle 31. The two bearings bolts 61, 62, which are of plastic and preferably polyamide, are pressed with their end of smaller diameter into a bore 63 of the clamping jaws 18, 19 and are oriented toward one another, or toward the center bit 21. The central double jaw 24 of the center bit 21 has an approximately trapezoidal recess 64, 65 at both ends, in the central plane, into which the bearing bolts 61, 62 can enter completely or partway. This is necessary because the bearing bolts 61, 62 have a length which amounts to the majority of the width of a downhill ski and thus exceeds the width of a cross-country ski in the event that a cross-country ski is to be clamped horizontally, i. e., lying flat, using the apparatus according to the invention. Aside from their function as a bearing surface for a horizontally clamped ski, the bearing bolts 61, 62 also serve to clamp skis in the vertical position, that is, on their sides or edgewise. To this end, the bearing bolts 61, 62 each have a bearing surface 66, 67, located opposite the respective divided bearing surfaces 68, 69 of the central double jaw 24. To show this horizontal or vertical clamping position of the skis more clearly, one ski 71 is shown in dot-dash lines lying horizontally on the left side, and one ski 72 is shown on the right lying vertically, that is, on edge, with the narrow side on the shoes 22, the ski 72 again being shown in dot-dash lines. It will be understood that the clamping has not yet been effected here.

To clamp a single ski, or both skis of a pair, the ski or skis are put in place horizontally or vertically, and then the threaded spindle 31 is driven in rotation with the aid of the eccentric lever, so that the movable clamping jaw 19 moves toward the stationary clamping jaw 18; the center bit 21 substantially always occupies the central position between the two clamping jaws 18, 19. This operation is continued until such time as the respective faces of the jaws from both directions rest lightly on the ski or skis. Then the eccentric lever 37 is pivoted out of its position of rest shown in FIG. 1 in the direction of the arrow B, until such time as the linear section 54 rests on the axial thrust bearing 56. As the eccentric lever 37 is pivoted, the threaded spindle 31 is moved slightly in the axial direction until such time as the faces of the jaw rest firmly against the ski or skis on both sides, whereupon only the tension spring 33 is tensioned further. In this way, a specific clamping force for the ski or skis is produced, defined by the tension spring 33. If only a single ski is clamped between the center bit 21 and one of the clamping jaws 18, 19, then the threaded spindle 31 must be moved until such time as the ski is located between the associated jaw faces, and the bearing surface of the associated unoccupied bearing bolt rests on the inside surface of the recess 64, 65 of the center bit 21. Then the eccentric lever 37 can be pivoted, as described above, in order to perform the actual clamping operation. In the illustrated exemplary embodiment, both the two clamping jaws 18, 19 and the two end faces of the center bit 21 have grooves 73 machined into them, extending parallel to the plane of the two guide rods 16, 17 and receiving the protruding portion of the steel edges of the skis when the skis are clamped in the horizontal position. It will be understood that the pivoting of the eccentric lever 37 and hence the clamping of the skis placed between the jaws and the center bit can be effected in any arbitrary rotational position of the eccentric lever 37.

What is claimed is:

1. An apparatus for the clamping of skis of various widths, comprising:

two parallel, elongated guide rods;

a stationary clamping jaw engaged by the guide rods and stationary relative to the guide rods;

a movable clamping jaw mounted to the guide rods for guided reciprocal movement along the guide rods relative to the stationary clamping jaw;

eccentric lever means;

a threaded spindle mounted at one end to the movable clamping jaw;

a tie bolt slidably mounted to the stationary clamping jaw and connected to the eccentric lever means;

a tension spring joined at one end to the threaded spindle and at the other end to the tie bolt; and a spring receiving element secured at one end of the threaded spindle and at one end of the tie bolt, each spring receiving element having a longitudinal extent and being provided on an outer circumference thereof with a groove which has a continuous longitudinal extent about said circumference into which said one end of the tension spring is secured, wherein:

said threaded spindle and said eccentric lever means being connected in a rotationally stiff manner so that a rotatable driving connection between the threaded spindle and the eccentric lever is assured;

the movable clamping jaw is reciprocated by the threaded spindle and the eccentric lever means; and the threaded spindle is rotatably by the eccentric lever means.

2. The apparatus as defined in claim 1, wherein the threaded spindle and the spring receiving element have on identical direction.

3. The apparatus as defined in claim 1, further comprising:

an axial thrust bearing mounted to the stationary clamping jaw, and wherein the eccentric lever means rests against the axial thurst bearing.

4. The apparatus as defined in claim 1, wherein the eccentric lever means includes a pivot shaft and a cam disc eccentrically mouted by the pivot shaft to said lever means, said cam disc having flattened areas which define detent areas.

5. The apparatus as defined in claim 4, wherein the eccentric lever means further includes a lever arm and an axial thrust bearing, and wherein one of said flattened areas extends at an acute angle to the lever arm and defines, as one of said detent positions, a rest position when engaging the axial thrust bearing.

6. The appartus as defined in claim 1, further comprising:

a center bit mounted on the guide rods between the stationary clamping jaw and the movable clamping jaw, said center bit including spaced apart recesses;

compression springs, one on each guide rod and between the center bit and the jaws; and a bearing bolt mounted to each clamping jaw and extending toward a respective recess of said center bit.

7. The appratus as defined in claim 6, wherein each clamping jaw has a bore in which one end of its respecting bearing bolt is mounted, and wherein the bearing bolts are plastic.

8. The apparatus as defined in claim 7, wherein the center bit includes at least one bearing surface facing each clamping jaw and each bearing bolt is provided on its free end with a bearing surface, which is located opposite an associated bearing surface on the center bit.

9. The apparatus as defined in claim 6, wherein the clamping jaws and the center bit include horizontally extending receiving grooves opposite one another and extending transversely to the direction of reciprocal movement of the movable clamping jaw.

* * * * *